United States Patent [19]

Eggleton

[11] 4,310,293

[45] Jan. 12, 1982

[54] APPARATUS FOR MOULDING CONCRETE

[76] Inventor: Richard C. Eggleton, 39 Geneva Crescent, Wagga Wagga, New South Wales, Australia

[21] Appl. No.: 135,891

[22] Filed: Mar. 31, 1980

[51] Int. Cl.[3] ..... B28B 1/04; B28B 3/24

[52] U.S. Cl. ..... 425/62; 404/98; 404/100; 404/101; 404/102; 404/105; 404/108; 404/110; 425/114; 425/122

[58] Field of Search ..... 249/2; 425/62, 122, 425/114; 280/638; 264/174, 172, 33, 35, 333; 404/98, 100, 101, 102, 105, 108, 110

[56] References Cited

U.S. PATENT DOCUMENTS

| | | | |
|---|---|---|---|
| 2,049,115 | 7/1936 | Hadley | 404/102 |
| 2,228,454 | 1/1941 | Hamilton | 280/638 |
| 2,410,271 | 10/1946 | Davidson et al. | 280/638 |
| 2,513,942 | 7/1950 | Johnson et al. | 280/638 |
| 2,853,250 | 9/1958 | Crom | 425/62 |
| 2,932,875 | 4/1960 | Butcher | 404/98 |
| 3,363,524 | 1/1968 | Catenacci | 42 5/62 |
| 3,585,911 | 6/1971 | Vlasic | 404/98 |
| 3,600,773 | 8/1971 | Davis | 249/2 |
| 3,605,580 | 9/1971 | Miller | 404/98 |
| 3,733,140 | 5/1973 | James | 404/98 |

FOREIGN PATENT DOCUMENTS

| | | | |
|---|---|---|---|
| 1476357 | 4/1967 | France | 404/98 |
| 1030997 | 5/1966 | United Kingdom | 404/98 |
| 1333040 | 10/1973 | United Kingdom | 404/120 |

*Primary Examiner*—Willard E. Hoag

*Attorney, Agent, or Firm*—Zarley, McKee, Thomte, Voorhees & Sease

[57] ABSTRACT

A machine for compacting and moulding concrete mix or other plastic materials comprises, in combination:

(a) a body structure;

(b) a tunnel shaped moulding member having a top and two sides and open at its bottom, the moulding member being attached to the body section;

(c) an opening in the top of the moulding member adjacent to the body section;

(d) a hopper adapted to carry concrete mix or other plastic materials, and feed the mix or materials to the opening, the hopper being attached to the body structure;

(e) a substantially vertical ram plate having a shape which corresponds to the cross-sectional shape of the moulding member, the ram plate being located within the moulding member and being adapted to move reciprocally from a first position adjacent to the body structure to a second position wholly within the moulding member, without oscillation of the ram plate;

(f) means to cause the reciprocal movement of the ram plate, the means being carried by the body structure, and (g) means supporting the body structure, the supporting means comprising at least one wheel which is steerable, and adjustable in height and adapted to move in a direction substantially opposite from and in response to said compaction; whereby said machine is sequentially and automatically repositioned by said compaction for further moulding and compacting.

4 Claims, 5 Drawing Figures

APPARATUS FOR MOULDING CONCRETE

This invention relates to apparatus for moulding concrete mix, asphalt or other plastic materials. It is particularly applicable to the "in situ" moulding of continuous concrete formations such as edgings, kerbing, guttering and the like.

In general, the present practice for formation of kerbing or guttering requires laying of formwork along the length of the kerbing or guttering to be formed, pouring concrete mix within the formwork, tamping the mix to consolidate it and remove air pockets from it, and then trowelling or other finishing by hand to the required conformation. As will be appreciated, this practice requires considerable skilled manual labour, not only in the finishing by hand, but also in the setting up of formwork to the required dimensions, and taking up and relaying the formwork as the work progresses. The practice is also time-consuming and non-continuous as the length of kerbing or guttering which can be formed is dependent upon the length of formwork laid in place for use.

There have been a number of previous proposals for machines which could be used for the continuous laying of concrete mix or other plastic materials. For example, U.S. Pat. No. 2,932,875 describes a self-propelled concrete moulding unit which, as will be seen from the following description, has a number of features that are similar to the present invention. However, that unit has a pivotally mounted ram that rocks from a first position to a second position to allegedly consolidate the concrete mix in a "ramming chamber." The compacted concrete mix is then delivered, under the action of the pivotally mounted ram plate, into a "mould box" having a cross-sectional shape which corresponds to the shape of the concrete formation being laid. That unit, however, is designed primarily for heavy-duty pavement laying and cannot be readily steered, notwithstanding the guide handle provided at its front end, nor can that unit operate within a trench.

A modification of the unit of U.S. Pat. No. 2,932,875 is described in the specification of Australian Pat. No. 427,457. This modified unit replaces the ineffective oscillating, pivotally mounted ram with a ram plate rigidly mounted on at least one rod, so arranged that both reciprocal and oscillatory movement of the ram plate is effected. This modified concrete mix moulding unit has a stoker arm assembly to facilitate the feeding of the concrete mix (or like material) to a ramming chamber and thence to the mould box, and also an ancillary hopper for applying a topping mix to the consolidated and moulded concrete mix. An additional feature of this unit is a tiller and wheel assembly, to keep the unit on a required line (the unit uses skids as the main support) and to perform small height adjustments to compensate for uneven ground. However, the tiller and wheel combination cannot be used to steer a curved course for the unit and in this respect the concrete laying machine of Australian Pat. No. 427,457 suffers the same disadvantage as its predecessor.

Another known design of concrete moulding machine is described in Australian Pat. No. 271,767. That specification discloses a vehicle mounted concrete moulding machine which is guided by a datum line member set up alongside a substantially flat surface. The moulding machine includes a number of sensors which are used to control the height of the mould of the machine, and the direction variation of the vehicle. Other controls are also available, including those for correcting side tilt and pitching of the vehicle. The concrete is consolidated into the mould by screw feeders or augers.

Only the first two or these prior art machines are self-propelling, and neither of those two machines is capable of movement other than substantially in a straight line. Since those units are designed primarily for laying relatively large surfaces of concrete, such as pedestrian pavements, their lack of steerability is generally not an important deficiency. However, there are occasions when more manoeuvrability is needed, such as when laying concrete garden edges, or when working in a narrow, non-straight trench, and it is an objective of the present invention to provide a self-propelled concrete moulding machine which has such manoeuvrability.

This objective is achieved by arranging for the concrete moulding machine to be supported on three or four wheels (or sometimes more than four) and to have at least one of those wheels a steerable wheel, which is adjustable in height.

According to the present invention, a machine for compacting and moulding concrete mix or other plastic material comprises, in combination:

(a) a body structure;

(b) a tunnel shaped moulding member having a top and two sides and open at its bottom, said moulding member being attached to said body section;

(c) an opening in the top of said moulding member adjacent to said body section;

(d) a hopper adapted to carry concrete mix or other plastic materials and feed the mix or materials to said opening, said hopper being attached to said body structure;

(e) a substantially vertical ram plate having a shape which corresponds to the cross-sectional shape of said moulding member, said ram plate being located within said moulding member and being adapted to move reciprocally from a first position adjacent to said body structure to a second position wholly within said moulding member, without oscillation of said ram plate;

(f) means to cause said reciprocal and non-oscillating movement of said ram plate, said means being carried by said body structure; and (g) means supporting said body structure, said supporting means comprising at least one wheel which is steerable, adjustable in height and adapted to move in a direction substantially opposite from and in response to said compaction; whereby said machine is sequentially and automatically repositioned by said compaction for further moulding and compacting.

Typically the supporting means will comprise at least three wheels, at least one of which is a fixed supporting wheel mounted on said body structure in the vicinity of the hopper. The fixed supporting wheel or wheels can be removed, if necessary, to allow the lower edges of the sides of the moulding member to rest on the ground and also act as a sliding support for the moulding machine.

Preferably, the ram plate and moulding member are arranged so that they extend lower than the underside of the body structure, and the means for causing reciprocal movement of the ram plate is an inclined plate having a vertical flange which is connected to at least one piston or the like, the horizontal movement of which is controlled by means for causing reciprocal motion of the piston or pistons (or the like).

Preferably also, the ram plate has one or more slots or holes therein, through which reinforcing wire or rod may pass.

Further features of the present invention will be apparent from the following description of embodiments thereof, illustrated in the accompanying drawings, of which:

In this specification, all relative positions, such as vertical, forward, above and below, when applied to the present invention, are used in the normal sense when the apparatus is positioned on substantially level ground, ready for use.

Figure 1:
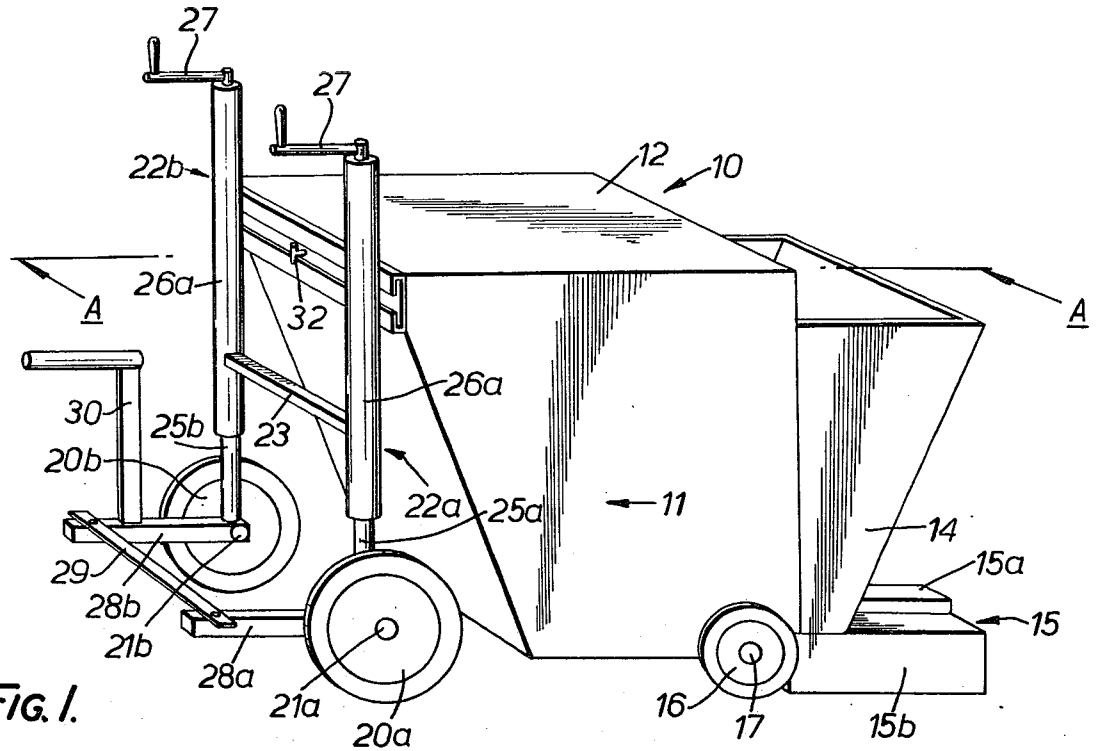
FIG. 1 is a perspective view of one form of apparatus for moulding concrete mix or the like in accordance with the present invention.

Referring firstly to FIG. 1, there is shown apparatus 10 which, in use, is adapted to move in the direction of arrow 11. (All references hereafter to "forward" and "rearward" and the like are to be construed accordingly.)

Apparatus 10 comprises a body structure 12 to the forward end of which is connected a supporting and steering mechanism, generally designated as 13. At the rearward end of body structure 12 is mounted a hopper 14 and a moulding member 15, which is described in more detail later. FIG. 1 also shows a supporting wheel 16 which is fitted to the body structure 12 by a stub axle 17. Although not shown in FIG. 1, a corresponding wheel 16 is fitted to the other side of the body structure.

The supporting and steering mechanism 13 consists of a pair of wheels 20*a*, 20*b* mounted on respective stub axles 21*a*, 21*b* at the lower ends of vertically adjustable members 22*a*, 22*b*. Members 22*a* and 22*b* are rigidly interconnected by cross-members 23 and 24, the latter being a member of generally T-section, which is described in more detail later. In the illustrated embodiment, vertical members 22*a* and 22*b* each comprise a pair of telescoping elongate members of circular section, the lower members 25*a*, 25*b* fitting within the upper members 26*a*, 26*b*. Telescoping movement of each of the lower members 25*a*, 25*b* within their respective upper members is effected by rotation of threaded bars (not shown) extending between the respective members, this rotation being effected using handles 27.

It will be appreciated that independent telescoping of members 22*a* and 22*b* allows for tilting of the body structure 12 to which the steering mechanism 13 is attached by means of cross-member 24. If the body structure 12 is tilted, one of the two wheels 16 may become unnecessary, in which case it may be removed from its respective stub axle 17. Alternatively, the position of the stub axles 17 may be vertically adjustable, so that at all times the apparatus is supported by four wheels in contact with the ground.

In the illustrated embodiment, the wheels 20*a* and 20*b* are steered in unison by means of a linkage mechanism attached to the lower end of each of the members 22*a* and 22*b*. This linkage mechanism comprises forwardly extending rods 28*a* and 28*b* rigidly attached to and extending from members 22*a* and 22*b* respectively, and a further cross member 29 which is pivotally attached at each end to the forward ends of rods 28*a* and 28*b*. In order to assist in steering of the wheels 20*a* and 20*b*, a steering handle 30 may be affixed as shown to one of the rods 28*a* and 28*b*.

As previously mentioned, steering mechanism 13 is mounted on body structure 12 by means of cross-member 24 which is of generally T-section. As shown in more detail in FIGS. 2 and 3, the cross member 24 is received within a C-shaped channel member 31 affixed to the upper forward portion of the body structure 12. In the illustrated embodiment, the cross member 24 is held in position by means of a threaded locking bolt 32, which passes in threaded engagement through member 24 and bears against the base of channel member 31. Loosening of bolt 32 permits relative sliding movement of cross member 24 along channel member 31, thereby allowing the steering mechanism 31 to be "off-set" in relation to the direction of movement of the apparatus 10. Of course, whilst bolt 32 is shown in the drawings as being located in the cross member 24 centrally between the members 22*a* and 22*b*, alternative locations may be provided closer to the ends of the cross member to enable the steering mechanism to be held in its "off-set" position by the bolt 32.

Alternative connections between the supporting and steering mechanism 13 and the body structure 12 will be readily envisaged by those skilled in the design of steerable apparatus.

Figure 2:
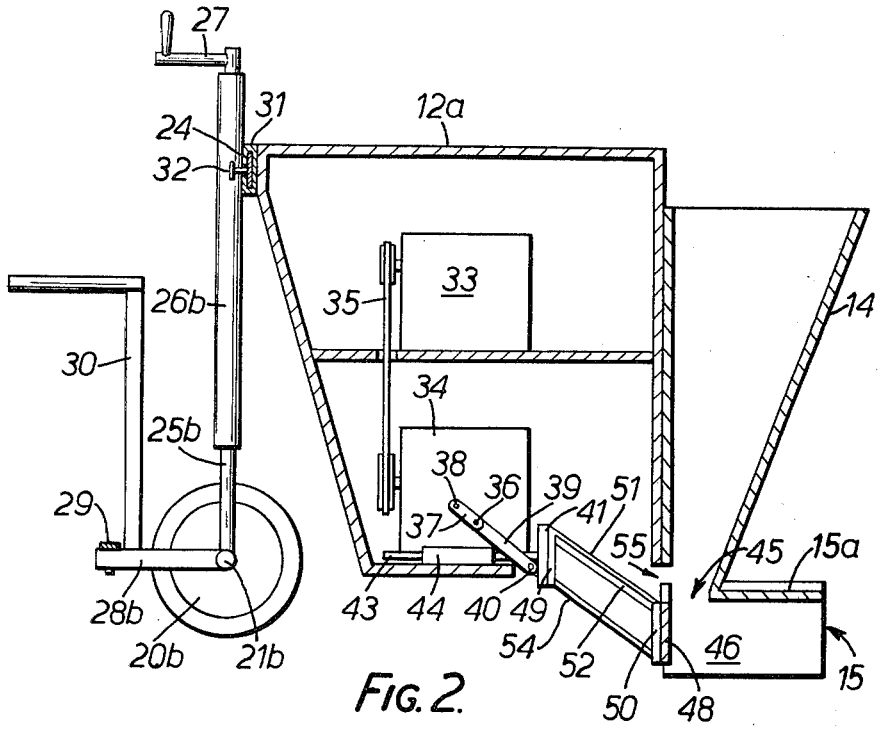
FIG. 2 is a side sectional view of the apparatus of FIG. 1 taken along the line A—A thereof, with the ram plate in its first position.
Figure 3:
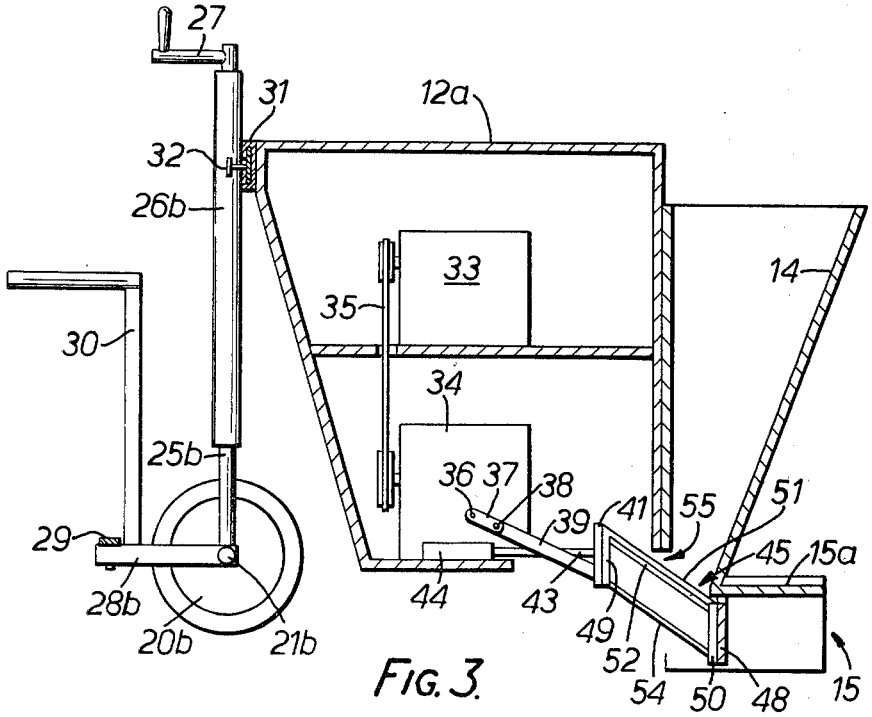
FIG. 3 is a similar view to FIG. 2 but with the ram plate in its second position.

FIGS. 2 and 3 illustrate the construction and operation of the apparatus in more detail. As shown, the frame 12*a* of the body structure 12 supports a motor 33, preferably mounted in the upper portion of body structure 12, with the motor 13 driving a reduction box 34 that is located beneath it by means of a belt, chain or the like 35. The output shafts 36 of reduction box 34 are arranged to extend from either side of box 34, transversely of the apparatus 10. Each output shaft 36 has rigidly mounted thereon a first linkage 37 (see particularly FIG. 3), the free ends of the first linkage 37 being pivotally attached at point 38 to one end of a second linkage 39. The other end of the second linkage 39 is pivotally attached at point 40 to a vertical, transverse plate 41 which forms, together with a pair of parallel rods 43 extending fore and aft on either side of reduction box 34, a reciprocable piston. Each rod 43 is rigidly attached to the plate 41, for example, by a threaded engagement within a socket welded or otherwise fixed to the plate 41. Each rod 43 is slidingly received within a tubular guide member 44 which is fixedly attached to the body structure 12.

It will be appreciated from a comparison of FIGS. 2 and 3, which illustrate the apparatus 10 with the output shaft 36 of reduction box 34 in different rotational positions, that the driving action of motor 33 which is communicated to reduction box 34 is converted by linkages 37 and 39, and the action of rods 43 sliding in guides 44, into reciprocal movement of the plate 41 between the two extreme positions shown in FIGS. 2 and 3.

A hopper 14 is attached to the rearward end of body structure 12. Hopper 14 may be of any desired size or configuration, and at its lower end it communicates via an opening 45 in a tunnel-shaped moulding member 15. The moulding member has a top section 15*a* and two side sections 15*b*. The top section may be any required shape, to suit the top surface shape of the moulded concrete structure. The opening 45 may be formed in the top section 15*a*. Alternatively, as shown in the drawings, the opening 45 may be formed immediately adjacent to the body structure 12 by the lateral extension of side sections 15*b* beyond the front edge of top section 15*a*. The bottom of moulding member 15 is open.

Figure 4:
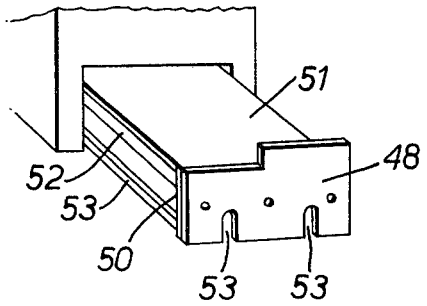
FIG. 4 shows one form of construction of the ram plate of the present invention and its connection to the reciprocating pistons of the apparatus illustrated in FIGS. 1, 2 and 3.

A ram plate 48 is positioned within the moulding member 15. As shown in FIGS. 2, 3 and 4, the ram plate is bolted or otherwise connected to flange 50 at one end of an inclined plate 51. Inclined plate 51 has a second flange 52 at its other end, which bolts to, or is otherwise connected to, plate 41 of the piston assembly controlled by the reduction box 34. Strengthening bars 52, 54 ensure that plate 51 is held rigid when under stress.

Other connections between plate 41 and ram plate 48 are, of course, possible.

As will be clear from FIGS. 2 and 3, reciprocal movement of plate 41 will result in a corresponding movement of ram plate 48. The extent of the reciprocal movement is between the positions shown in FIGS. 2 and 3. In common with the terminology of this art, the region 46 within which ram plate 48 moves may be termed the ramming chamber of the illustrated apparatus.

By using an inclined plate 51, any tendency for concrete to spill through aperture 55 and interfere with the reciprocal motion control of ram plate 48 is overcome. If the inclined plate 51 is replaced simply by a plurality of rigid rods interconnecting plate 41 and ram plate 48, aperture 55 is replaced by an equal plurality of slots, within which the connecting rigid rods can move.

The ram plate 48 has a shape which corresponds to the cross-sectional shape of moulding member 15. As shown in FIG. 4, it may also have a series of slots 53, or holes (not shown) through which steel reinforcing wire or rod may be fed when the apparatus is in use (provided, of course, that flange 50, if present, has corresponding slots or holes formed therein). The slots 53 need not be of uniform width, as illustrated in FIG. 4, but may be key-hole slots or slots of any convenient configuration.

As shown in the drawings, the moulding member 15 is preferably positioned so that the lower edges of its sides are lower than the bottom of the body structure 12. In this way, the apparatus may be used to mould concrete mix (or like material) in a trench with wheels 16, 20*a* and 20*b* straddling the trench. If wheels 20*a* and 20*b* are replaced by a single steerable wheel, the single wheel could conveniently be located within a trench, provided it is possible to adjust the height of that wheel, relative to the body structure 12. The wheel 16 may be removed so that the lower edges of sides 15*a* and 15*b* form the rear support for the concrete moulding machine, and also prevent any concrete mix being moulded from moving sideways relative to the moulding member. The lower edges of sides 15*a* and 15*b* may be formed to have an outwardly projecting lip or flange to ensure that they can slide freely over the ground in such circumstances.

Figure 5:
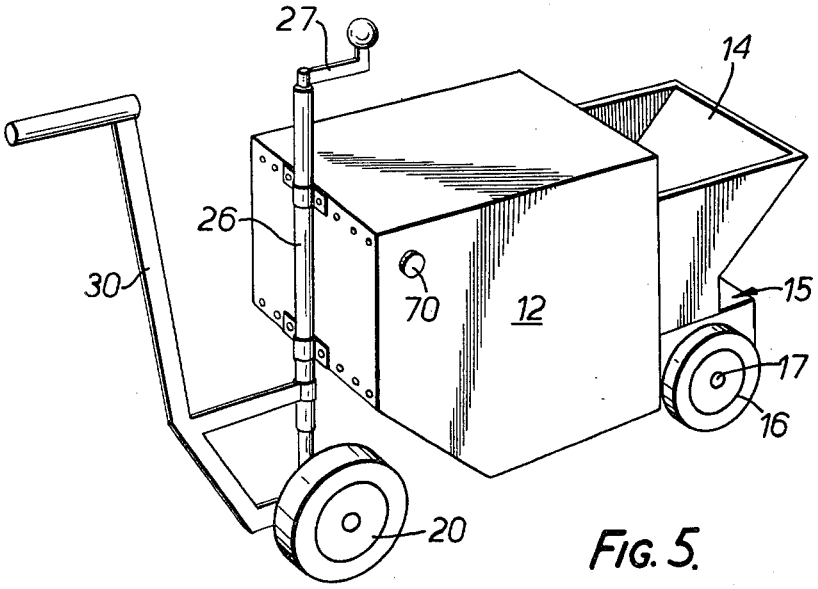
FIG. 5 is a general perspective view of another embodiment of the present invention.

FIG. 5 illustrates an alternative embodiment in which the parts which correspond directly to parts of the embodiment of FIGS. 1, 2 and 3 bear the same reference numerals. An electrical socket 70 is provided for the supply of power to an electric motor in this embodiment. The single steerable wheel is referenced 20.

The apparatus of the present invention may be used in several ways. For example, if a shallow trench of six to nine inches is formed along the line of a desired kerbing or guttering and the moulding apparatus is positioned above the trench with the lower portions of the moulding member 15 of a required shape extending into the trench, and the steerable wheels 20*a* and 20*b* (in the case of an embodiment similar to that illustrated in FIGS. 1, 2 and 3) suitably positioned either straddling the trench or to one side of it. Concrete mix or other plastic material is loaded into hopper 14 and, with the ram plate 48 in its first position (see FIG. 2), this material passes into the ram chamber 46 now located within the pre-formed trench. Reciprocation of ram 42 is then commenced so that the material within chamber 42 is forced out through mould 15, and, at the same time downwardly to the base of the trench.

Each time ram plate 48 packs concrete material into mould 15, the apparatus 10 is automatically moved forwardly along the trench as the freshly moulded concrete is forced against the concrete packed and moulded by the previous stroke. Further concrete is added to hopper 14 as required during operation of the apparatus, and steering of the apparatus, even around curves, can be achieved by suitably guiding the steerable wheel 20 or wheels 20*a* and 20*b*. Where the apparatus of this invention is being used on a sloping surface, a horizontal moulding may nevertheless be formed by suitable adjustments of the members 22*a* and 22*b* to maintain the body structure 12 level.

If required, plates of expansion material, formed to the cross-sectional shape of the moulding member 15, may be fed through the hopper (when empty of concrete mix) and pressed by the ram plate into position at the end of the moulded mix. Further concrete mix may then be added to the hopper and the kerbing, guttering or the like can continue to be moulded.

If the ram plate 48 (and flange 50) have slots 53 or holes to permit it, steel reinforcing wire or rod can be fed into the concrete mix as it is moulded.

The present invention is not limited in use to moulding concrete mix or other plastic materials in a trench. It has been found to be capable of operating on flat ground, with the height of the wheels adjusted so that the lower edges of side sections 15*b* of the moulding member 15 just clear the ground, to form small concrete walls, and also to form concrete posts, concrete bricks, steps, and the like.

I claim:

1. A machine for compacting and moulding concrete mix or other plastic materials comprising, in combination:

(a) a body structure;

(b) a tunnel shaped moulding member having a top and two sides and open at its bottom, said moulding member being attached to said body section;

(c) an opening in the top of said moulding member adjacent to said body section;

(d) a hopper adapted to carry concrete mix or other plastic materials, and feed the mix or materials to said opening, said hopper being attached to said body structure;

(e) a substantially vertical ram plate having a shape which corresponds to the cross-sectional shape of said moulding member, said ram plate being located within said moulding member and being adapted to move reciprocally from a first position adjacent to said body to a second position wholly within said moulding member, while maintaining said substantially vertical position, and wherein said ram plate has at least one slot or hole formed therein, through which steel reinforcing rod or wire can be fed to the region within said moulding;

(f) means to cause said reciprocal movement of said ram plate, said means being carried by said body structure, and comprising a motor driving a reduction box having an output shaft connected by linkages to a piston arrangement, said piston arrangement being connected to said ram plate and including a horizontally moving piston wherein the connection between said piston arrangement and said ram plate includes a plate or at least one rod, the plane or longitudinal direction of which is at an acute angle relative to the horizontal; and (g) means supporting said body structure, said supporting means comprising at least one wheel which is steerable, adjustable in height and adapted to move in a direction substantially opposite from and in response to said compaction; whereby said machine is sequentially and automatically repositioned by said compacting for further moulding and compacting.

2. A machine as defined in claim 1, wherein said moulding member is located so that said sides extend below the lowermost part of said body structure.

3. A machine as defined in claim 1 or 2 in which the or each said steerable wheel is mounted on said body structure by means permitting sideways adjustment of the position of the or each steerable wheel.

4. A machine as defined in claim 1 or 2, in which said supporting means includes at least one nonsteerable wheel which is adjustable in height relative to said body structure.

* * * * *